United States Patent [19]

Clarke

[11] Patent Number: 4,759,868

[45] Date of Patent: Jul. 26, 1988

[54] GENERAL-PURPOSE CLEANING COMPOSITION

[75] Inventor: David E. Clarke, Bromborough, Great Britain

[73] Assignee: Lever Brothers Company, New York, N.Y.

[21] Appl. No.: 39,049

[22] Filed: Apr. 16, 1987

[30] Foreign Application Priority Data

Apr. 22, 1986 [GB] United Kingdom ..... 8609806

[51] Int. Cl.[4] ..... C11D 1/68

[52] U.S. Cl. ..... 252/170; 252/174.21; 252/174.23; 252/DIG. 1; 252/DIG. 10; 252/DIG. 14

[58] Field of Search ..... 252/DIG. 1, DIG. 10, 252/174.21, DIG. 14, 174.23, 170

[56] References Cited

U.S. PATENT DOCUMENTS

| | | | |
|---|---|---|---|
| 3,539,518 | 11/1970 | Feighner et al. | 252/89 |
| 3,682,849 | 8/1972 | Smith et al. | 260/615 B |
| 4,443,270 | 4/1984 | Biard et al. | 134/25.2 |
| 4,448,704 | 5/1984 | Barby et al. | 252/91 |
| 4,474,678 | 10/1984 | Lutz et al. | 252/174.21 |
| 4,479,016 | 10/1984 | Klahr et al. | 568/606 |
| 4,508,635 | 4/1985 | Clarke | 252/174.23 |

FOREIGN PATENT DOCUMENTS

| | | |
|---|---|---|
| 17149 | 10/1980 | European Pat. Off. . |
| 66342 | 12/1982 | European Pat. Off. . |
| 125711 | 11/1984 | European Pat. Off. . |
| 1273108 | 7/1968 | Fed. Rep. of Germany . |
| 2745275 | 10/1977 | Fed. Rep. of Germany . |

*Primary Examiner*—Robert Wax
*Assistant Examiner*—Ronald A. Krasnow
*Attorney, Agent, or Firm*—Milton L. Honig; James J. Farrell

[57] ABSTRACT

A liquid general-purpose cleaner, having improved non-streak and cleaning properties, is obtained if in a liquid-compatible medium which comprises a nonionic surfactant, an at least partially esterified resin and water or a mixture of water and a water-miscible organic solvent, as nonionic a topped nonionic surfactant is used containing less than 2% by weight of non-alkoxylated material and less than 4% by weight of mono-alkoxylated material. By using this nonionic surfactant, less partially esterified resin and less perfume are required to achieve effects similar to those obtained when a non-topped nonionic surfactant is used.

2 Claims, No Drawings

GENERAL-PURPOSE CLEANING COMPOSITION

The present invention relates to a liquid generalpurpose cleaning composition having improved non-streak and cleaning properties.

In our published European patent application No. 0 066 342 we have described liquid general-purpose cleaning compositions with a "streak-free" cleaning benefit, which means that if a hard surface is cleaned with such a composition the hard surface, when dry, does not show a residue in the form of visible, dull streaks to any significant degree. These compositions comprise, as essential ingredients, a nonionic detergent surfactant and an at least partially esterified resin.

We have now found that such compositions can be further improved by using a particular class of nonionic detergent surfactants. The use of this particular class of nonionic detergent surfactants surprisingly enables a reduction of the level of the at least partially esterified resin without loss of the streak-free benefit, and sometimes even improves the overall cleaning power of the composition. It also enables a reduction of perfumes in such compositions while maintaining the same perfume impact.

The particular class of nonionic detergent surfactants consists of nonionic detergent surfactants having a low level of free alcohol or of an alcohol with a low alkoxylation degree.

Nonionic detergent surfactants are usually prepared by condensing a hydroxyl-group-containing organic hydrophobic moiety, such as fatty alcohols, alkylphenols, amides and the like, with an alkylene oxide such as ethylene oxide. Such materials and their processes of manufacture are well known in the art and have been amply described in e.g. "Nonionic Surfactants", M. Dekker Inc., New York, 1967, author M. Schick, and in "Surface-Active Ethylene Oxide Adducts", Pergamon Press, Oxford, England, 1969, author N. Schönfeldt.

Such processes, however, usually result in a product mixture comprising a number of derivatives of varying alkoxylate content, as well as non-alkoxylated material. Thus, the condensation of a fatty alcohol with n moles of alkylene oxide usually results in an end product with an average number of n alkylene oxide units per molecule of fatty alcohol, but in reality such an end product will consist of a mixture of nonalkoxylated alcohol and alkoxylated alcohol with more or less alkylene oxide units per molecule than the average value n.

We have now found that the use of nonionic detergent surfactants with a low level of non-alkoxylated alcohol or of an alcohol with a low alkoxylation degree is surprisingly beneficial in our non-streak cleaning compositions.

Such nonionic detergent surfactants are known in the art as "topped" or "peaked" nonionic detergent surfactants. Topped nonionic detergent surfactants can be made by subjecting the usual nonionic detergent surfactant to a steam distillation treatment, by which the free and low alkoxylated alcohol can be removed, and peaked nonionic detergent surfactants can be made by carrying out the alkoxylation with special catalysts which results in products with a much sharper peak in the alkoxylate distribution. Topped nonionic detergent surfactants are e.g. described in U.S. Pat. No. 3,682,849.

The topped or peaked nonionic detergent surfactants suitable for the present invention contain an average number of alkylene oxide units of between 3 and 15, preferably of between 4 and 12 per molecule of the hydrophobic moiety, i.e. a $C_6$–$C_{18}$ primary or secondary, straight or branched chain alcohol, and contain less than 2% by weight of non-alkoxylated alcohol, and less than 4% by weight of mono-alkoxylated alcohol. Particularly suitable are nonionic detergent surfactants with these specifications and prepared from $C_{11}$–$C_{15}$ primary alcohols condensed with 7–11 moles of ethylene oxide, $C_9$–$C_{11}$ oxo-alcohols condensed with 5 moles of ethylene oxide, and $C_6$–$C_{10}$ linear primary alcohols condensed with 4.5 moles of ethylene oxide.

The above-identified class of nonionic detergent surfactants can be used in the compositions according to our aforementioned European patent application, which is hereby included by way of reference. All other details concerning the general-purpose cleaning compositions of the present invention can be found in this reference, which is hereby made part of the description of the present invention.

Thus, the compositions comprise the nonionic detergent and the at least partially esterified resin in a liquid-compatible medium.

The compatible liquid medium may consist of water, or mixtures of water and one or more water-miscible organic solvents. Typical examples of such solvents are the lower aliphatic water-miscible alcohols such as ethanol, propanol, isopropanol, butanol and so on. Other alcohols, such as tetrahydrofurfurol, may also be used. Glycols, such as ethylene- and propylene-glycol and glycolethers, such as the mono- and dimethyl, -propyl, -isopropyl, -butyl, -isobutylethers of ethyleneglycol, di- and tri-ethyleneglycol may also be used. Analogous propyleneglycolethers may also be used.

In general, the liquid medium will make up from 1 to 99.985% by weight of the final composition. Normally, this will be from 50 to 97.9%, and preferably from 55 to 92.5% by weight of the final composition.

In general, when dissolved in water, the HLB-value of the nonionic surfactant or mixture of nonionic surfactants should lie between about 10 and below about 15. Nonionic surfactants with an HLB-value of below about 11 are generally not soluble in water to any appreciable extent without another active detergent present, but it is possible to dissolve higher levels of such low HLB-nonionic surfactants in mixtures of water and an organic solvent.

For optimum streak-free results the nonionic surfactant should preferably provide a cloud point of the aqueous solution of the final composition above the temperature of normal use of the diluted solution.

This can be achieved by a proper choice of the type of nonionic surfactant or mixtures of various nonionic surfactants or by the co-use of another detergent surfactant, such as an anionic or amphoteric surfactant.

In general, from 0.01–98% by weight of the final composition of one or more nonionic surfactants will be present in the final composition. Usually, this amount will range from 2 to 30% by weight, and it has been found that at least 5% should be present to obtain both a reduced streaking and an improved cleaning effect.

Preferably, therefore, the amount of nonionic detergent surfactant will range from 5–30%, and especially preferably from 7–25% by weight of the final composition.

The at least partially esterified resin to be used in the present invention can be either partly derived from natural sources or wholly synthetic in origin. An example of a resin partly derived from natural sources is the at least partially esterified adduct of rosin and an unsaturated dicarboxylic acid or anhydride.

Examples of wholly synthetic resins are at least partially esterified derivatives of co-polymerization products of mono-unsaturated aliphatic, cycloaliphatic or aromatic monomers having no carboxy groups and unsaturated dicarboxylic acids or anhydrides thereof. Normally, these copolymers will contain equimolar proportions of the monomer and the dicarboxylic acid or anhydride, but copolymers with higher ratios of monomer to dicarboxylic acid or anhydride are also suitable, provided they can be solubilized in the liquid medium.

Typical examples of suitable copolymers are copolymers of ethylene, styrene, and vinylmethylether with maleic acid, fumaric acid, itaconic acid, citraconic acid and the like and the anhydrides thereof. Preferred are the styrene/maleic anhydride copolymers.

The partly natural or wholly synthetic resins are at least partially esterified with a suitable hydroxyl-containing compound. Examples of suitable hydroxyl-containing compounds are aliphatic alcohols such as methanol, ethanol, propanol, isopropanol, butanol, isobutanol, ethylhexanol and decanol, higher primary alcohols, glycol ethers such as the butyl ether of ethylene glycol and polyols such as ethylene glycol, glycerol, erythritol, mannitol, sorbitol, polyethylene glycol, polypropylene glycol, and so on. The choice of the esterification agent and the degree of esterification depend upon the solubility requirements of the at least partially esterified resin in an (alkaline) liquid medium of the type hereabove described and the viscosity profile of the compositions of the invention in practical use. The choice of the esterification agent and the degree of esterification also influence the water hardness sensitivity of the at least partially esterified resin in the compositions of the invention when, for example, these are diluted with hard water either for large surface area cleaning or during rinsing. For optimum streak-free results the choice of esterification agent and the degree of esterification should be such as to give an at least partially esterified resin which, when used in the composition of the invention, does not give a cloudy solution when diluted with hard water, owing to the precipitation of the calcium or magnesium salt of the resin or salting out of the resin by the hardness salts present in the water. It is to be understood that the choice of the esterification agent does not embrace the nonionic surfactants mentioned above.

The at least partial esterification is to be understood to imply that at least 5%, preferably at least 10% and especially preferably at least 20%, particularly 25% of the free carboxy groups of the resin are esterified with the hydroxyl group containing compound. The esterification can also be complete, i.e. 100% of the free carboxyl groups are esterified. It is to be understood that the latter compound does not embrace the nonionic detergent surfactants mentioned above.

Typical examples of at least partially esterified resins for use in the present invention are partially esterified adducts of rosin with maleic anhydride, such as the products SR 83, SR 88, SR 91 (ex Schenectady Chemicals), having an esterification degree of about 65, about 50 and about 50% respectively; Durez 17211 and Durez 15546 (ex Hooker Electro-Chemical Co.), having an esterification degree of about 60 and 65% respectively; Alresat KM (ex Hoechst), having an esterification degree of about 40%; Pentalyn 255 (ex Hercules); SMA 1140 H, SMA TM 9123 and SMA 7092 (ex Arco Co.), having an esterification degree of about 70, about 50 and about 60% respectively; Ubatol R 300 and R 400 (ex Staley), styrene-based copolymers having an esterification degree of about 40% Shanco 334 (ex Shanco Plastics), a modified polyester resin having an esterification degree of about 40%; partially esterified copolymers of styrene with maleic anhydride, esterified with isobutanol such as Scripset 520, 540 and 550 (ex Monsanto), having an esterification degree of about 20, about 45 and about 45% respectively; and polyvinylmethylether/-maleic anhydride copolymers, partially esterified with butanol, such as Gantrez ES 425 (ex GAF Corp.), having an esterification degree of about 50%.

Suitable examples of the preferred esterified resins are the partially esterified copolymers of styrene with maleic anhydride. e.g. Scripset 540 and 550 (ex Monsanto), partially esterified adducts of rosin with maleic anhydride, e.g. SR 91 (ex Schenectady Chemicals) and Alresat KM 140 (ex Hoechst), modified polyester resins, e.g. Shanco 334 (ex Shanco Plastics) and polyvinyl methylether/maleic anhydride copolymers, partially esterified with butanol, e.g. Gantrez ES 425 (ex GAF Corp.).

Mixtures of various partially or fully esterified resins may also be used, as well as mixtures of partially or fully esterified and non-esterified resins. Thus, mixtures of Scripset 550 and SR 91, Scripset 550 and Shanco 334, and SR 91 and Shanco 334 give good results, as well as mixtures of Scripset 550 and SMA 2000A (which is a non-esterified styrene-maleic anhydride copolymer).

The molecular weight of the resins of the invention may vary from about a thousand to a few million. The at least partially esterified resins should have a sufficient solubility in a neutral or alkaline liquid medium, preferably in an aqueous medium. The partially esterified resin may, if necessary, be hydrolysed and subsequently neutralized or made alkaline so that in normal use it is present in the compositions of the invention in soluble form as the alkali metal, ammonium or substituted ammonium or alkaline earth metal salt, or as the salt of a suitable amine or mixtures thereof. This, of course, does not apply to the fully esterified resins.

In general, the compositions of the invention will contain from 0.005 to 20%, usually from 0.1 to 15% and preferably from 0.5 to 10% by weight of the at least partially esterified resin. The at least partially esterified resin may be incorporated in the final composition after having been prepared separately, or it may be prepared in situ. In the latter case, however, a careful control and adjustment of the amount of esterifying hydroxy compound is necessary.

It has furthermore been found that best results are obtained with the compositions of the inventions if they are substantially electrolyte-free. This is to be understood in this way that the compositions, apart from their above-described essential ingredients, do not contain further electrolytes in an amount of more than 5% by weight. It may sometimes be useful to include a low amount of a buffer such as alkali metaborates, -carbonates, or a builder salt such as phosphates, citrates, NTA, EDTA, Dequest, etc. to inactivate the calcium and magnesium ions present in the wash liquor, but preferably the compositions contain less than 3% or even no further electrolytes at all.

The compositions may furthermore contain optional ingredients such as preservatives, bactericides, hydrogen peroxide, thickening agents, organic buffers such as the alkanolamines, colouring agents, perfumes and plasticizers. They may also contain, besides the nonionic detergent surfactants, low levels of other detergent surfactants which should preferably be rather calcium-insensitive. Typical examples thereof are the fatty acid soaps, the alkylaryl sulphonates, alkylether sulphates, i.e. the sulphation products of the above-described nonionic detergent surfactants, secondary alkane sulphonates, amphoteric surfactants and mixtures thereof. The compositions of the invention are normally alkaline; if necessary, the pH is adjusted to alkaline values by means of a suitable alkaline material. In this case the alkaline material is not understood to be included in the electrolytes as discussed above.

The products of the invention may be used as such, i.e. neat, or they may be diluted with water before use to a concentration of generally from 0.1 to 10%.

The present invention will be further illustrated by way of example.

EXAMPLE 1

Black tiles were treated with the following neat compositions, and were subsequently rinsed with tap water. The tiles were thereafter visually assessed for the presence of streaks.

The formulations of the neat compositions were as follows:

| | % by weight |
|---|---|
| A. $C_9$–$C_{11}$ primary alcohol, condensed with 5 moles of ethylene oxide (free alcohol content 4.6%; mono EO alcohol content 3.4%) | 7% |
| $C_{14}$–$C_{15}$ primary alcohol, condensed with 18 moles of ethylene oxide | 1% |
| Copolymer of styrene with maleic anhydride, partially esterified (esterification degree 45%) with isobutanol and neutralized to the sodium salt (av. mol. wt. 10,000) | from 0–1% |
| Demineralized water | to 100. |
| B. As above, but using a topped $C_9$–$C_{11}$ primary alcohol, condensed with 5 moles of ethylene oxide, having a free alcohol content of 0.6% and a mono EO alcohol content of 1.98% | |

The following results were obtained:

| Partially esterified resin | Streak Results A | Streak Results B |
|---|---|---|
| 1% | not streaky | not streaky |
| 0.9 | " | " |
| 0.8 | " | " |
| 0.7 | " | " |
| 0.6 | streaky | " |
| 0.5 | " | " |
| 0.4 | " | " |
| 0.3 | " | streaky |
| 0.2 | " | " |
| 0.1 | " | " |
| 0 | " | " |

EXAMPLE 2

Repeating Example 1, but using a 1:100 dilute solution at room temperature in demineralized water gave the following results:

| | A | B |
|---|---|---|
| 1% | not streaky | not streaky |
| 0.6 | streaky | " |
| 0.5 | " | " |
| 0.4 | " | streaky |
| 0.3 | " | " |
| 0.2 | " | " |
| 0.1 | " | " |
| 0 | " | " |

EXAMPLE 3

Repeating Example 2, but using a 1:100 dilute solution in hard water (32/8) at 45? C. gave the following results:

| | A | B |
|---|---|---|
| 1% | not streaky | not streaky |
| 0.6 | streaky | " |
| 0.5 | " | " |
| 0.4 | " | streaky |
| 0.3 | " | " |
| 0.2 | " | " |
| 0.1 | " | " |
| 0 | " | " |

EXAMPLE 4

Formulations A and B, containing 0.5% of the partially esterified resin and additionally 0.2% of a thickening agent (a xanthan gum) were assessed by a panel of 10 people as to the odour characteristics. Both products were equally rated. Repeating this test after having added 0.3% of a perfume resulted in a preference of 9:1 for product B, which contained the topped nonionic.

I claim:

1. A liquid general-purpose cleaning composition with improved non-streak and cleaning properties, comprising 0.01–98% by weight of a nonionic surfactant, 0 005–20% by weight of an at least partially esterified resin, derived from an unsaturated dicarboxylic acid or anhydride, and 1–99.91% by weight of a compatible liquid medium which consists of water or a mixture of water and one or more water-miscible organic solvents, the at least partially esterified resin being at least 5% esterified with a hydroxyl group-containing compound selected from the group consisting of aliphatic alcohols, glycol ethers and polyols, said compound not being a nonionic detergent surfactant, wherein the nonionic surfactant is a $C_6$–$C_{18}$ primary or secondary, straight or branched chain alcohol condensed with 3–15 moles of alkylene oxide, and contains less than 2% by weight of non-alkoxylated alcohol and less than 4% by weight of mono-alkoxylated alcohol.

2. A composition according to claim 1, wherein the nonionic surfactant is selected from the group consisting of a $C_{11}$–$C_{15}$ linear primary alcohol condensed with 7–11 moles of ethylene oxide, a $C_9$–$C_{11}$ oxo-alcohol condensed with 5 moles of ethylene oxide, and a $C_6$–10 linear primary alcohol condesed with 4.5 moles of ethylene oxide.

* * * * *